US011796239B2

(12) United States Patent
DuPlessis et al.

(10) Patent No.: US 11,796,239 B2
(45) Date of Patent: Oct. 24, 2023

(54) METHOD FOR ENHANCING ICE CAPACITY IN AN ICE MAKING APPLIANCE

(71) Applicant: Haier US Appliance Solutions, Inc., Wilmington, DE (US)

(72) Inventors: Samuel Vincent DuPlessis, Louisville, KY (US); Rachel Winckler, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 203 days.

(21) Appl. No.: 17/314,588

(22) Filed: May 7, 2021

(65) Prior Publication Data

US 2022/0357089 A1 Nov. 10, 2022

(51) Int. Cl.

*F25C 5/187* (2018.01)
*F25C 5/182* (2018.01)
*F25C 5/20* (2018.01)

(52) U.S. Cl.

CPC ..... *F25C 5/187* (2013.01); *F25C 5/182* (2013.01); *F25C 5/22* (2018.01); *F25C 2400/10* (2013.01); *F25C 2600/00* (2013.01); *F25C 2600/02* (2013.01)

(58) Field of Classification Search

CPC .. F25C 5/187; F25C 5/22; F25C 5/182; F25C 2400/10; F25C 2600/00; F25C 2600/02
See application file for complete search history.

(56) References Cited

U.S. PATENT DOCUMENTS

| | | | | |
|---|---|---|---|---|
| 4,533,310 | A * | 8/1985 | Spinner | F25C 1/147 264/28 |
| 5,165,255 | A | 11/1992 | Alvarez | |
| 9,810,471 | B2 | 11/2017 | Kang | |
| 2014/0182323 | A1 | 7/2014 | Brunner | |
| 2015/0121942 | A1* | 5/2015 | Yun | F25C 5/187 62/344 |
| 2017/0023287 | A1 | 1/2017 | Dongjeong | |
| 2017/0292752 | A1 | 10/2017 | Lee | |

FOREIGN PATENT DOCUMENTS

| | | | |
|---|---|---|---|
| CN | 109724342 | A * | 5/2019 |
| KR | 20110006870 | A | 1/2011 |

OTHER PUBLICATIONS

Translation CN-109724342-A.*

* cited by examiner

*Primary Examiner* — Elizabeth J Martin
(74) *Attorney, Agent, or Firm* — Dority & Manning, P.A.

(57) ABSTRACT

An ice making appliance includes an ice maker for producing ice, an ice bin defining a bottom trough that extends between a rear end and a dispensing chute, wherein the ice is supplied at the rear end and is collected in the ice bin, an auger rotatably mounted within the bottom trough of the ice bin, and a motor assembly mechanically coupled to the auger for selectively rotating the auger. A controller is configured to rotate the auger in an advancing direction to urge the ice toward the dispensing chute and periodically rotate the auger in a reverse direction to redistribute the ice proximate the rear end of the ice bin.

19 Claims, 9 Drawing Sheets

METHOD FOR ENHANCING ICE CAPACITY IN AN ICE MAKING APPLIANCE

FIELD OF THE INVENTION

The present subject matter relates generally to ice making appliances, and more particularly to methods of operating an ice making appliance to facilitate increased ice storage capacity.

BACKGROUND OF THE INVENTION

Ice makers generally produce ice for use by consumers, such as for cooling foods or drinks to be consumed, for chilling other items, or for various other purposes. Certain refrigerator appliances include ice makers for producing ice. The ice maker can be positioned within the appliance's freezer chamber and direct ice into an ice bucket where it can be stored within the freezer chamber. Stand-alone ice makers have been developed and are available to consumers. These ice makers are separate from refrigerator appliances and provide independent ice supplies. Generally, ice is provided into an interior volume of these icemakers.

Both refrigerator ice makers and stand-alone ice makers typically include a dispensing system for assisting a user with accessing ice produced by the ice maker. For example, dispensing systems may include augers to urge ice through a dispensing outlet. However, as ice is deposited in one location of the ice bin and drawn out through another, ice has a tendency to accumulate in one region. Notably, this ice accumulation commonly triggers ice level sensors to prevent further production of ice or overflows the ice bucket at one location. As a result, the ice bin is rarely filled to full capacity, resulting in dissatisfied consumers when large volumes of ice are desired within a short time period.

Accordingly, an ice making appliance with improved ice storage capacity would be desirable. More specifically, an ice making appliance that operates to ensure that the ice bin remains filled to full capacity would be particularly beneficial.

BRIEF DESCRIPTION OF THE INVENTION

Aspects and advantages of the invention will be set forth in part in the following description, or may be obvious from the description, or may be learned through practice of the invention.

In one exemplary embodiment, an ice making appliance is provided, including an ice maker for producing ice, an ice bin defining a bottom trough that extends between a rear end and a dispensing chute, wherein the ice is supplied at the rear end and is collected in the ice bin, an auger rotatably mounted within the bottom trough of the ice bin, a motor assembly mechanically coupled to the auger for selectively rotating the auger, and a controller operably coupled to the motor assembly. The controller is configured to rotate the auger in an advancing direction to urge the ice toward the dispensing chute and periodically rotate the auger in a reverse direction to redistribute the ice proximate the rear end of the ice bin.

In another exemplary embodiment, a method for operating an ice making appliance is provided. The ice making appliance includes an ice bin defining a bottom trough that extends between a rear end and a dispensing chute, an auger rotatably mounted within the bottom trough of the ice bin, and a motor assembly mechanically coupled to the auger for selectively rotating the auger. The method includes rotating the auger in an advancing direction to urge ice toward the dispensing chute and periodically rotating the auger in a reverse direction to redistribute the ice proximate the rear end of the ice bin.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
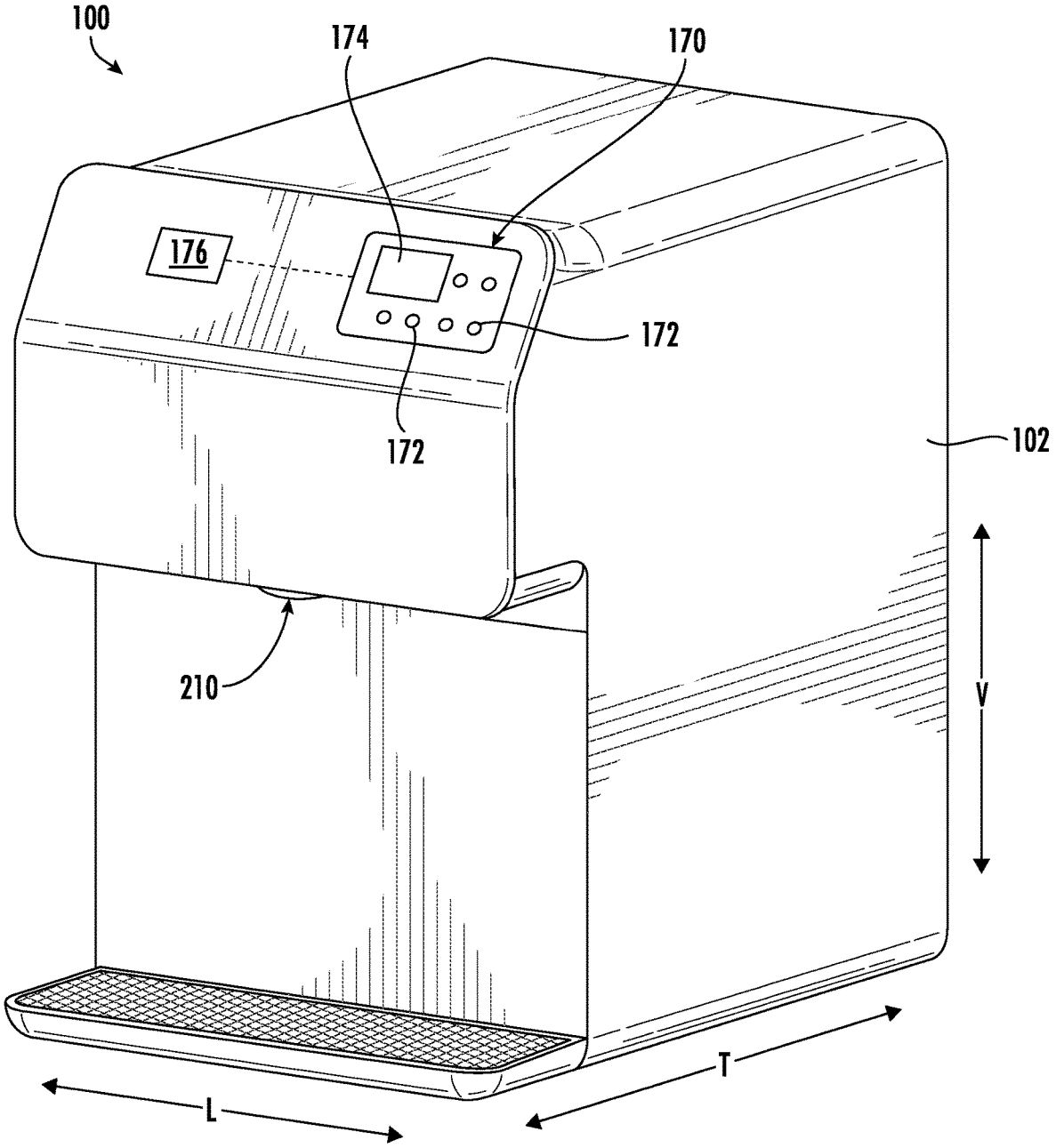
FIG. 1 provides a perspective view of a countertop ice making appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Figure 2:
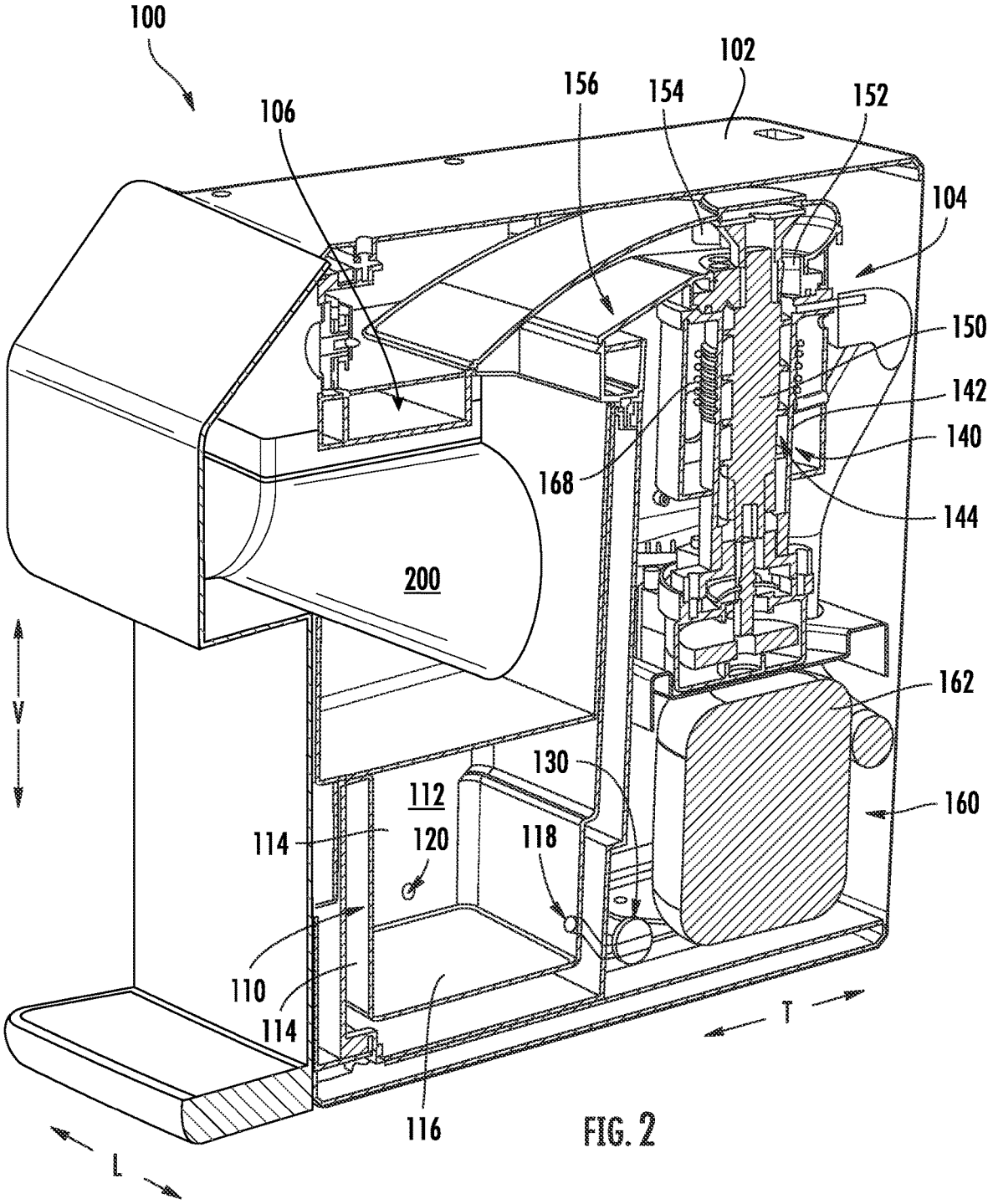
FIG. 2 provides a cross-sectional view of the exemplary ice making appliance of FIG. 1 according to exemplary embodiments of the present disclosure.

Referring now to the figures, an exemplary ice making appliance will be described in accordance with exemplary aspects of the present subject matter. Specifically, FIG. 1 provides a perspective view of an exemplary ice making appliance 100 and FIG. 2 provides a side cross-sectional view of ice making appliance 100. According to exemplary embodiments, ice making appliance 100 includes a casing 102 that is generally configured for containing and/or supporting various components of ice making appliance 100 and which may also define one or more internal chambers or compartments of ice making appliance 100. In this regard, as used herein, the terms "casing," "cabinet," "housing," and the like are generally intended to refer to an outer frame or support structure for ice making appliance 100, e.g., including any suitable number, type, and configuration of support structures formed from any suitable materials, such as a system of elongated support members, a plurality of interconnected panels, or some combination thereof. It should be appreciated that casing 102 does not necessarily require an enclosure and may simply include open structure supporting various elements of ice making appliance 100. By contrast, casing 102 may enclose some or all portions of an interior of casing 102. It should be appreciated that casing 102 may have any suitable size, shape, and configuration while remaining within the scope of the present subject matter.

As illustrated, ice making appliance 100 generally defines a vertical direction V, a lateral direction L, and a transverse direction T, each of which is mutually perpendicular, such that an orthogonal coordinate system is generally defined. As illustrated, casing 102 generally extends between a top and a bottom along the vertical direction V, between a first side (e.g., the left side when viewed from the front as in FIG. 1) and a second side (e.g., the right side when viewed from the front as in FIG. 1) along the lateral direction L, and between a front and a rear along the transverse direction T. In general, terms such as "left," "right," "front," "rear," "top," or "bottom" are used with reference to the perspective of a user accessing ice making appliance 100. Ice making appliance 100 is generally sized and shaped to be supported on a conventional residential or commercial countertop. Nonetheless, it is understood that ice making appliance 100 is provided as an exemplary embodiment and the present disclosure not limited to any particular size or shape, except as otherwise provided herein.

Figure 3:
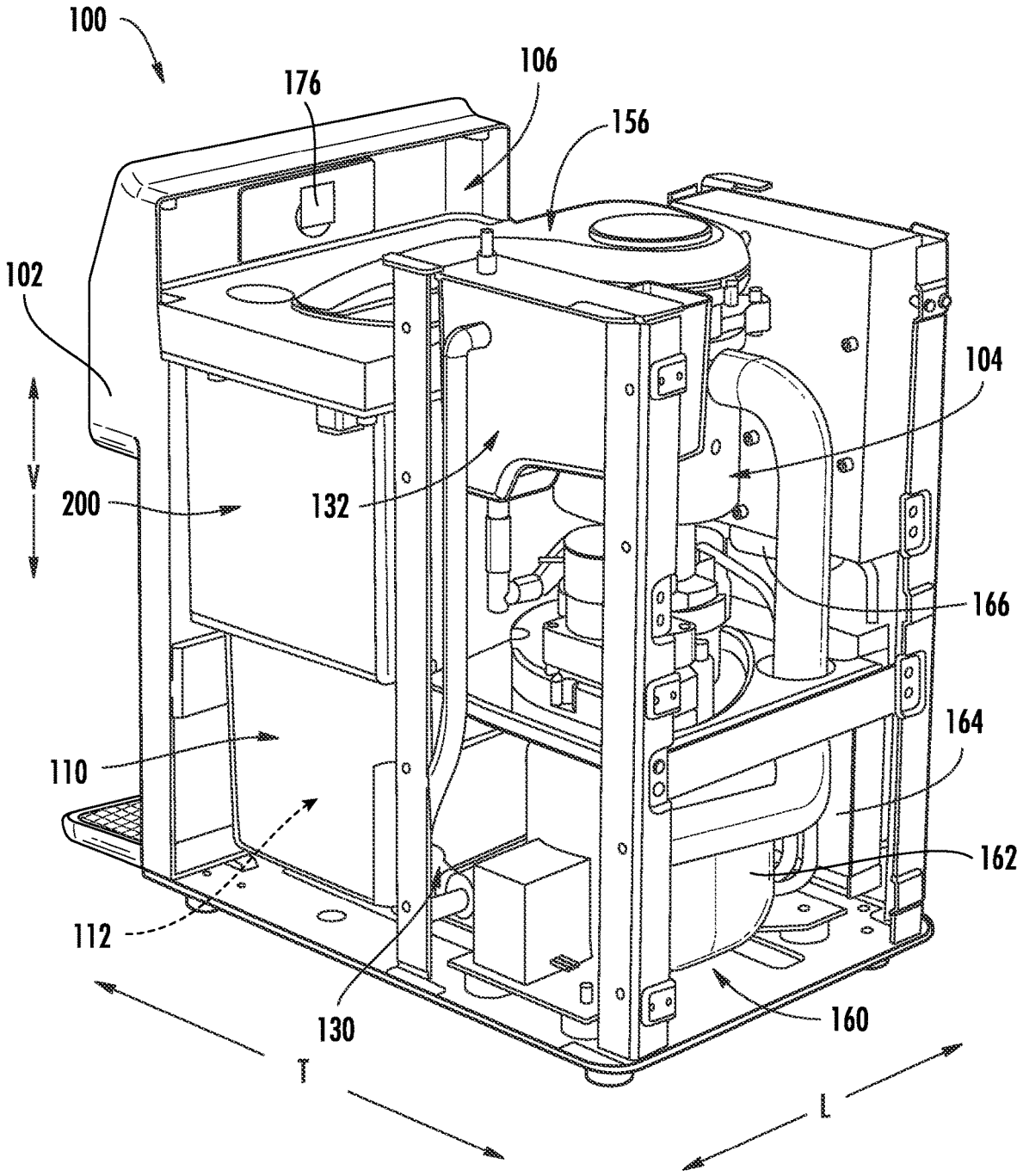
FIG. 3 provides a rear perspective view of the exemplary ice making appliance of FIG. 1 with an outer casing removed.
Figure 4:
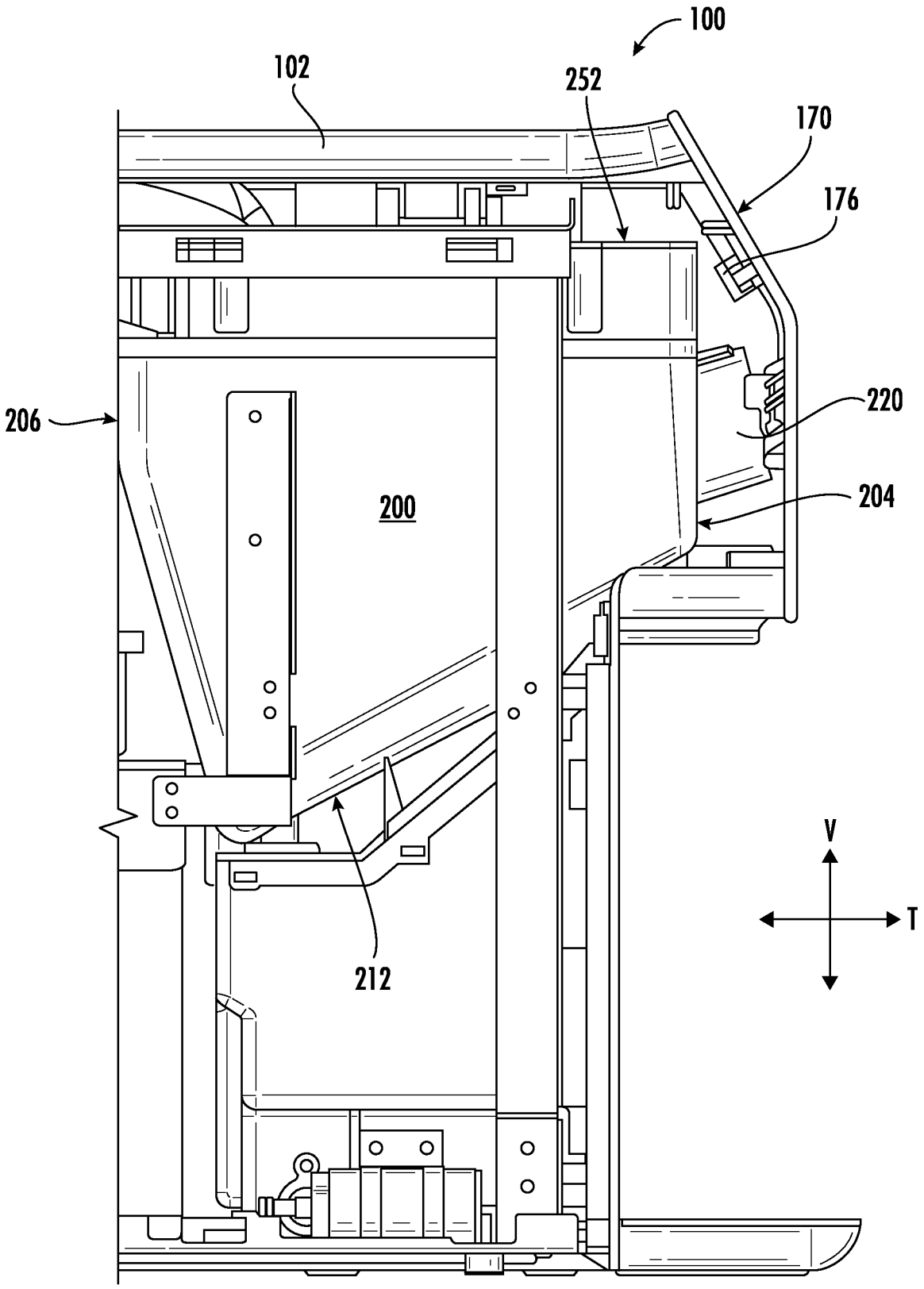
FIG. 4 provides a side view of the exemplary ice making appliance of FIG. 1 with an outer casing removed.
Figure 5:
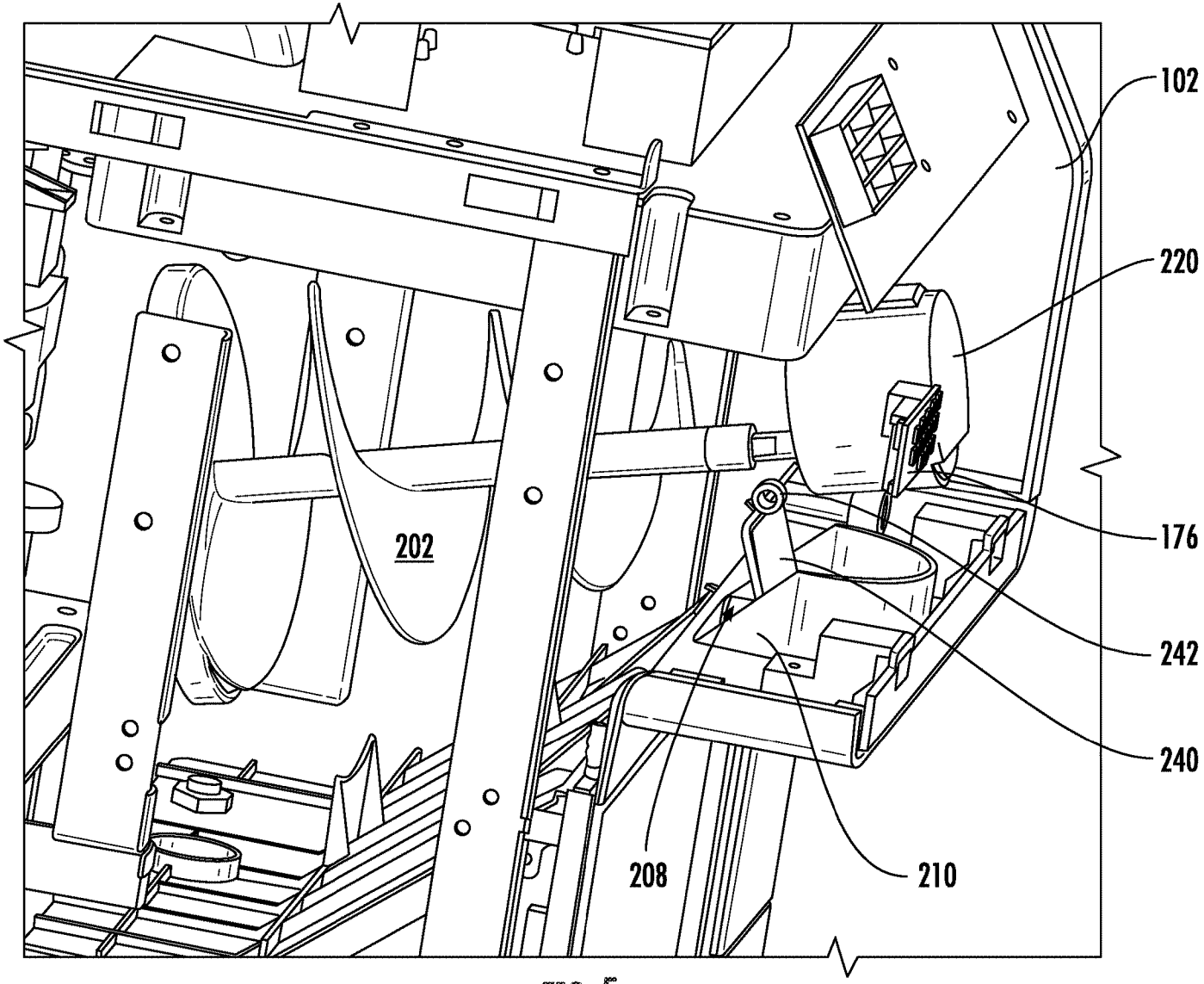
FIG. 5 provides a perspective view of an exemplary ice dispensing assembly of the exemplary ice making appliance of FIG. 1 according to exemplary embodiments of the present disclosure.
Figure 6:
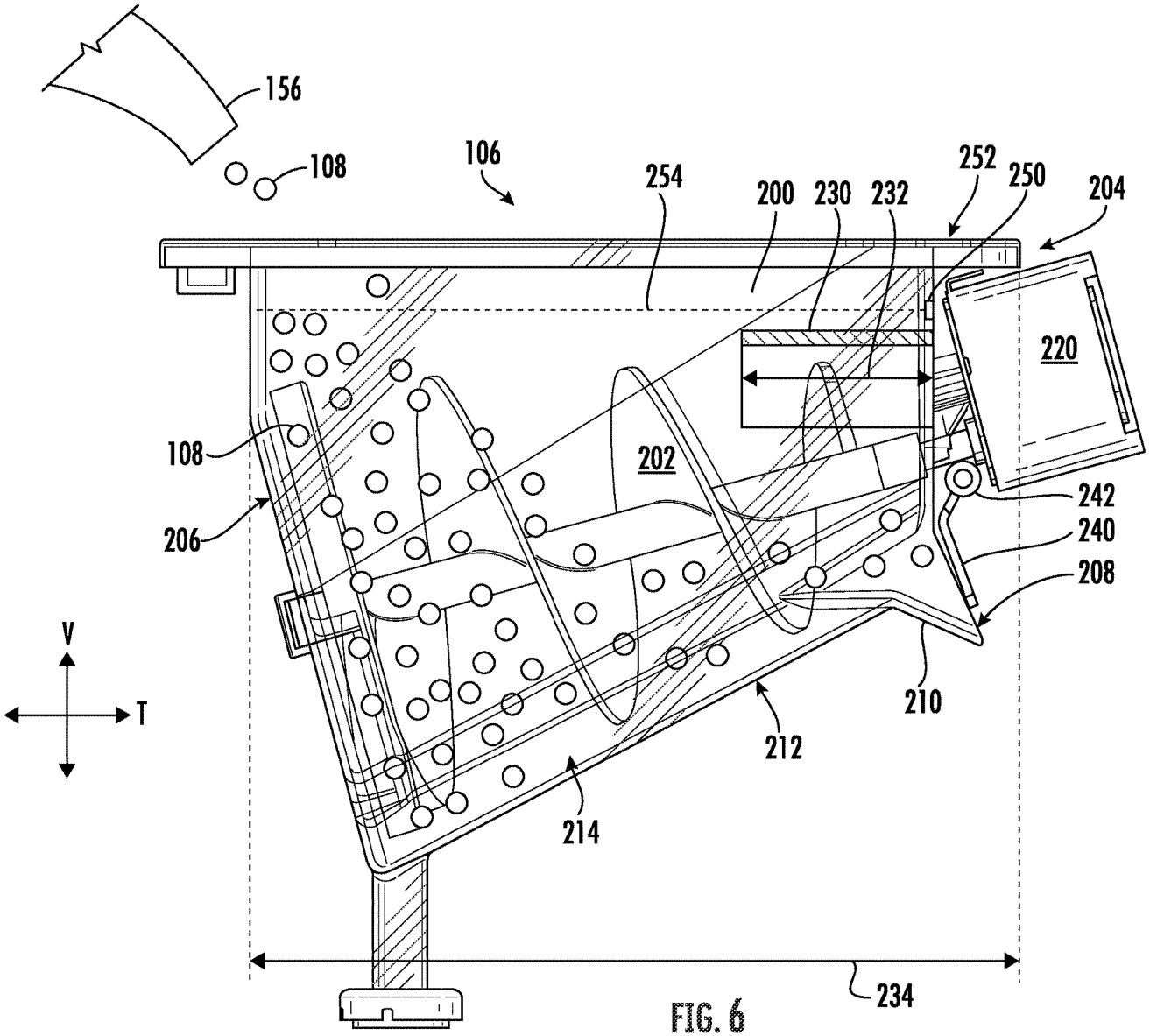
FIG. 6 provides a side view of the exemplary ice dispensing assembly of FIG. 5 with an ice bin illustrated in phantom according to exemplary embodiments of the present disclosure.
Figure 7:
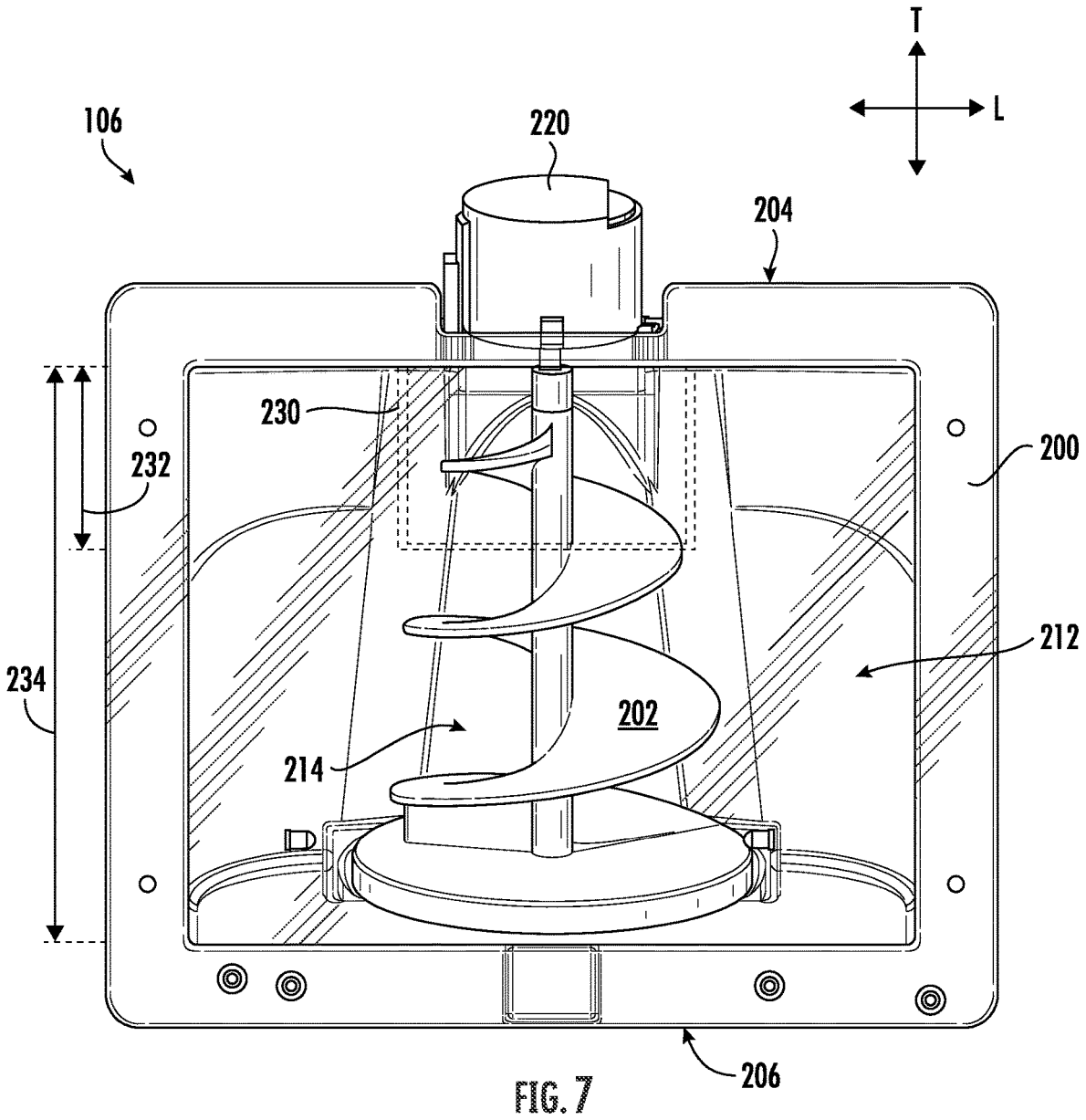
FIG. 7 provides a top view of the exemplary ice dispensing assembly of FIG. 5.
Figure 8:
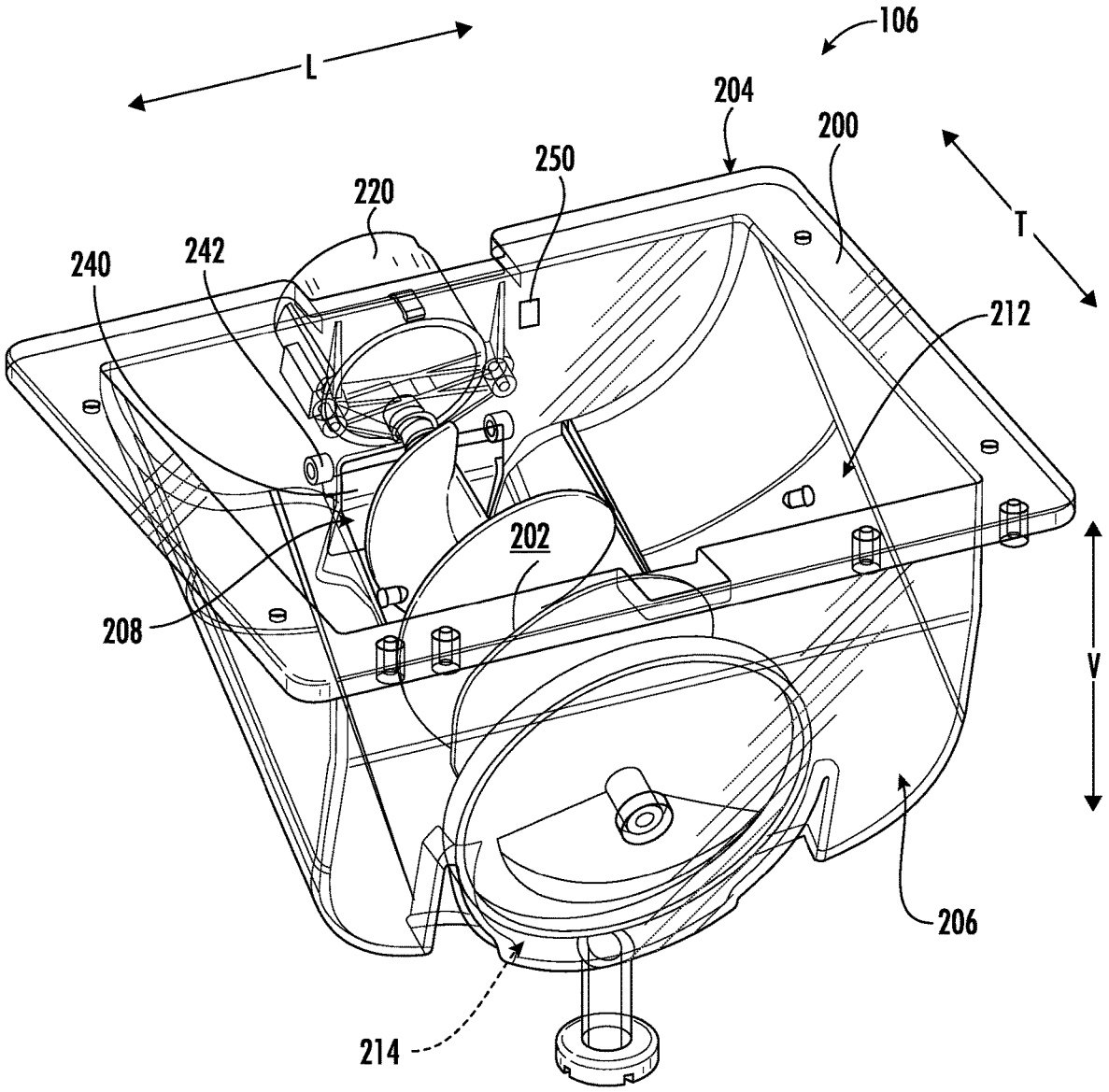
FIG. 8 provides a rear, perspective view of the exemplary ice dispensing assembly of FIG. 5 with an ice bin illustrated in phantom according to exemplary embodiments of the present disclosure.

Turning now generally to FIGS. 1 through 3, ice making appliance 100, will be described in more detail according to exemplary embodiments of the present subject matter. In general, ice making appliance 100 includes an ice maker 104 that is generally configured for producing ice and an ice dispensing assembly 106 that is generally configured for storing and dispensing the formed ice (e.g., as illustrated in FIG. 6 by reference numeral 108) to a user of ice making appliance 100. Each of these components and assemblies will be described in more detail below according to an exemplary embodiment of the present subject matter. However, it should be appreciated that other means for forming, storing, and dispensing ice 108 may be used while remaining within the scope of the present subject matter.

As best shown in FIG. 2, ice making appliance 100 generally includes a water tank 110 that generally defines a storage volume 112 for the receiving and holding of water that may be used during the ice formation process. Specifically, as illustrated, water tank 110 may include one or more sidewalls 114 and a base wall 116 which may together define the storage volume 112. According to exemplary embodiments, water tank 110 may be positioned within casing 102 and adjacent ice maker 104. As shown, water tank 110 may define a water supply opening 118 that may be fluidly coupled to ice maker 104 such that water from within storage volume 112 may be supplied to icemaker 104 to form ice 108.

According to the illustrated embodiment, water tank 110 may further define an inlet opening 120 through which water may be supplied into storage volume 112. In this regard, for example, ice making appliance 100 may be plumbed with a water line or conduit that is directly coupled to inlet opening 120 for providing water into water tank 110 for use in the ice forming process. Alternatively, inlet opening 120 may be defined through water tank 110 downstream from a water storage tank which may be, for example, filled with water and attached to a side of ice making appliance 100. According to still other exemplary embodiments, water tank 110 may be manually filled, e.g., by a user of the appliance. In this regard, for example, water tank 110 may be removable from casing 102 where it may be filled at a sink or another water supply source before it is reinstalled to facilitate the ice formation process.

Generally, ice making appliance 100 includes ice maker 104 downstream of water tank 110 and water supply opening 118. Thus, when assembled, ice maker 104 may receive a steady supply water to facilitate ice formation. To continually supply water to icemaker 104, ice making appliance 100 may further include a pump 130 that may be in fluid communication with the storage volume 112. For example, water may be flowable from the storage volume 112 through water supply opening 118 defined in the water tank 110, such as in a sidewall 114 thereof, and may flow through a conduit to and through pump 130. Pump 130 may, when activated, actively flow water from the storage volume 112 therethrough and from the pump 130.

Water actively flowed from the pump 130 may be flowed (e.g., through a suitable conduit) to a reservoir 132 (FIG. 3). For example, reservoir 132 may define another storage volume, which may, for example, be in fluid communication with the pump 130 and may thus receive water that is actively flowed from the water tank 110, such as through the pump 130. For example, water may be flowed into reservoir 132 through an opening defined in the reservoir 132. Reservoir 132 and the storage volume thereof may receive and contain water to be provided to an ice maker 104 for the production of ice 108. Accordingly, reservoir 132 may be in fluid communication with ice maker 104. For example, water may be flowed, such as through an opening and through suitable conduits, from the storage volume to ice maker 104.

Ice maker 104 generally receives water, such as from reservoir 132, and freezes the water to form ice 108. In exemplary embodiments, ice maker 104 is a nugget ice maker, and in particular is an auger-style ice maker, although other suitable styles of ice makers are within the scope and spirit of the present disclosure. As shown, ice maker 104 may include a casing 140 into which water from reservoir 132 is flowed. Casing 140 is thus in fluid communication with reservoir 132. For example, casing 140 may include one or more sidewalls 142 which may define an interior volume 144, and an opening may be defined in a sidewall 142. Water may be flowed from reservoir 132 through the opening (such as via a suitable conduit) into the interior volume 144.

As illustrated, an auger 150 may be disposed at least partially within the casing 140. During operation, the auger 150 may rotate. Water within the casing 140 may at least partially freeze due to heat exchange, such as with a refrigeration system as discussed herein. The at least partially frozen water may be lifted by the auger 150 from casing 140. Further, in exemplary embodiments, the at least partially frozen water may be directed by auger 150 to and through an extruder 152. The extruder 152 may extrude the at least partially frozen water to form ice 108, such as nuggets of ice.

In some embodiments, for example, a sweep 154, which may for example be connected to and rotate with the auger 150, may contact the ice 108 emerging through the extruder 152 from the auger 150 and direct the ice 108 out of ice maker 104 through a supply chute 156. Specifically, according to exemplary embodiments, ice making appliance 100 may include supply chute 156 for directing ice 108 produced by the ice maker 104 towards a dispensing assembly 106, which will be described in more detail below. For example, as shown, supply chute 156 is generally positioned above dispensing assembly 106 along the vertical direction V. Thus, ice 108 can slide off of supply chute 156 and drop into dispensing assembly 106. Supply chute 156 may, as shown, extend between ice maker 104 and dispensing assembly 106, and may direct ice 108 into a storage bin, as described in more detail below.

As discussed, water within the casing 140 may at least partially freeze due to heat exchange, such as with a refrigeration system. In exemplary embodiments, ice maker 104 may include a sealed refrigeration system 160. The sealed refrigeration system 160 may be in thermal communication with the casing 140 to remove heat from the casing 140 and interior volume 144 thereof, thus facilitating freezing of water therein to form ice 108. Sealed refrigeration system 160 may, for example, include a compressor 162, a condenser 164, a throttling device 166, and an evaporator 168. Evaporator 168 may, for example, be in thermal communication with the casing 140 in order to remove heat from the interior volume 144 and water therein during operation of sealed system 160. For example, evaporator 168 may at least partially surround the casing 140. In particular, evaporator 168 may be a conduit coiled around and in contact with casing 140, such as the sidewall(s) 142 thereof.

During operation of sealed system 160, refrigerant exits evaporator 168 as a fluid in the form of a superheated vapor or vapor mixture. Upon exiting evaporator 168, the refrigerant enters compressor 162 wherein the pressure and temperature of the refrigerant are increased such that the refrigerant becomes a superheated vapor. The superheated vapor from compressor 162 enters condenser 164 wherein energy is transferred therefrom and condenses into a saturated liquid or liquid vapor mixture. This fluid exits condenser 164 and travels through throttling device 166 that is configured for regulating a flow rate of refrigerant therethrough. Upon exiting throttling device 166, the pressure and temperature of the refrigerant drop at which time the refrigerant enters evaporator 168 and the cycle repeats itself. In certain exemplary embodiments, throttling device 166 may be a capillary tube. Notably, in some embodiments, sealed system 160 may additionally include fans (not shown) for facilitating heat transfer to/from the condenser 164 and evaporator 168.

As discussed, in exemplary embodiments, ice 108 may be nugget ice. Nugget ice is ice that that is maintained or stored (i.e., in an ice bin) at a temperature greater than the melting point of water or greater than about thirty-two degrees Fahrenheit. Accordingly, the ambient temperature of the environment surrounding the ice bin may be at a temperature greater than the melting point of water or greater than about thirty-two degrees Fahrenheit. In some embodiments, such temperature may be greater than forty degrees Fahrenheit, greater than fifty degrees Fahrenheit, or greater than sixty degrees Fahrenheit.

Referring again to FIG. 1, ice making appliance 100 may include a control panel 170 that may represent a general-purpose Input/Output ("GPIO") device or functional block for ice making appliance 100. In some embodiments, control panel 170 may include or be in operative communication with one or more user input devices 172, such as one or more of a variety of digital, analog, electrical, mechanical, or electro-mechanical input devices including rotary dials, control knobs, push buttons, toggle switches, selector switches, and touch pads. Additionally, ice making appliance 100 may include a display 174, such as a digital or analog display device generally configured to provide visual feedback regarding the operation of ice making appliance 100. For example, display 174 may be provided on control panel 170 and may include one or more status lights, screens, or visible indicators. According to exemplary embodiments, user input devices 172 and display 174 may be integrated into a single device, e.g., including one or more of a touchscreen interface, a capacitive touch panel, a liquid crystal display (LCD), a plasma display panel (PDP), a cathode ray tube (CRT) display, or other informational or interactive displays.

Ice making appliance 100 may further include or be in operative communication with a processing device or a controller 176 that may be generally configured to facilitate appliance operation. In this regard, control panel 170, user input devices 172, and display 174 may be in communication with controller 176 such that controller 176 may receive control inputs from user input devices 172, may display information using display 174, and may otherwise regulate operation of ice making appliance 100. For example, signals generated by controller 176 may operate ice making appliance 100, including any or all system components, subsystems, or interconnected devices, in response to the position of user input devices 172 and other control commands. Control panel 170 and other components of ice making appliance 100 may be in communication with controller 176 via, for example, one or more signal lines or shared communication busses. In this manner, Input/Output ("I/O") signals may be routed between controller 176 and various operational components of ice making appliance 100.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 176 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 176 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 176 may be operable to execute programming instructions or micro-control code associated with an operating cycle of ice making appliance 100. In this regard, the instructions may be software or any set of instructions that when executed by the processing device, cause the processing device to perform operations, such as running one or more software applications, displaying a user interface, receiving user input, processing user input, etc. Moreover, it should be noted that controller 176 as disclosed herein is capable of and may be operable to perform any methods, method steps, or portions of methods as disclosed herein. For example, in some embodiments, methods disclosed herein may be embodied in programming instructions stored in the memory and executed by controller 176.

The memory devices may also store data that can be retrieved, manipulated, created, or stored by the one or more processors or portions of controller 176. The data can include, for instance, data to facilitate performance of methods described herein. The data can be stored locally (e.g., on controller 176) in one or more databases and/or may be split up so that the data is stored in multiple locations. In addition, or alternatively, the one or more database(s) can be connected to controller 176 through any suitable network(s), such as through a high bandwidth local area network (LAN) or wide area network (WAN). In this regard, for example, controller 176 may further include a communication module or interface that may be used to communicate with one or more other component(s) of ice making appliance 100, controller 176, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

Referring now also to FIGS. 4 through 8, ice dispensing assembly 106 will be described in more detail according to exemplary embodiments of the present subject matter. In this regard, ice dispensing assembly 106 generally includes an ice bin 200 and a dispensing mechanism, illustrated herein as an auger 202. In operation, formed ice 108 may be provided by the ice maker 104 into ice bin 200, e.g., via supply chute 156 which is positioned above ice bin 200 and proximate a rear of ice bin 200. As explained in more detail below, this ice 108 generally collects below the supply chute 156 in a rear of ice bin 200 until auger 202 advances it forward or until gravity causes it to fall and form a pile of ice 108.

More specifically, ice bin may generally define a front end 204 that is positioned proximate a front of ice making appliance 100 and a rear end 206 that is positioned proximate ice maker 104 within casing 102. As illustrated, front end 204 and rear end 206 are spaced apart along the transverse direction T. In addition, ice bin 200 may generally define a discharge outlet 208 and a dispensing chute 210. In this regard, as auger 202 urges ice 108 toward front in 204 of ice bin, the ice 108 may pass through discharge outlet 208 and be directed into a cup or other container through dispensing chute 210. In addition, according to the illustrated embodiment, ice bin 200 includes a bottom wall 212 that defines a bottom trough 214 that generally collects ice 108 within ice bin 200. According to the illustrated embodiment, auger 202 is generally positioned at least partially within bottom trough 214 and is rotatably mounted within ice bin 200. In this manner, rotating auger 202 generally serves to move ice 108 within ice bin 200.

According to the illustrated embodiment bottom wall 212 and/or bottom trough 214 are generally angled upward toward dispensing chute 210. In this regard, for example, bottom trough 240 may be angled from the rear end 206 upward toward dispensing chute 210. In addition, according to the illustrated embodiment, auger 202 and bottom trough 214 are generally tapered toward dispensing chute 210. However, it should be appreciated that according to alternative embodiments, ice bin 200, auger 202, and/or dispensing chute 210 may have any other suitable shape, size, configuration, and relative orientation while remaining within the scope of the present subject matter.

As illustrated, ice dispensing assembly 106 further includes a motor assembly 220 that is mechanically coupled to auger 202 for selectively rotating auger 202. Specifically, according to the illustrated embodiment, motor assembly 220 is mounted in front of ice bin 200, e.g., behind a control panel 170 of ice making appliance 100. As used herein, "motor" may refer to any suitable drive motor and/or transmission assembly for rotating the auger 202. For example, motor assembly 220 may include a brushless DC electric motor, a stepper motor, or any other suitable type or configuration of motor. For example, motor assembly 220 may include an AC motor, an induction motor, a permanent magnet synchronous motor, or any other suitable type of AC motor. In addition, motor assembly 220 may include any suitable transmission assemblies, clutch mechanisms, or other components. According to an exemplary embodiment, motor assembly 220 may be operably coupled to a controller (not shown), which is programmed to rotate auger 202 as described herein.

Notably, ice dispensing assembly 106 may further include features for preventing ice 108 from falling through dispensing chute 210 or discharge outlet 208 when ice making appliance 100 is not actually dispensing ice 108 into a cup or container. In this regard, for example, ice bin 200 may include a deflector 230 that is positioned above auger 202 proximate dispensing chute 210. According to exemplary embodiments, deflector 230 is generally configured for preventing ice 108 from falling through dispensing chute when auger 202 is running in the advancing direction (e.g., to dispense ice) and/or in the reverse direction (e.g., for redistributing ice as described in more detail below). Notably, deflector 230 may generally have any suitable shape, size, or configuration suitable for preventing ice 108 from falling through discharge outlet 208. For example, according to the illustrated embodiment, deflector 230 is arcuate in wraps at least partially around auger 202. In addition, deflector 230 may define a deflector depth 232 and the bin 200 may define a bin depth 234, both of which may be measured along the transverse direction T. According to exemplary embodiments, deflector depth 232 may be greater than about 1/10, one quarter, one third, one half, or greater, of bin depth 234.

In addition, ice dispensing assembly 106 may include a pivoting flap or closing mechanism for selectively closing dispensing chute 210 and/or discharge outlet 208. For example, according to the illustrated embodiment, ice dispensing assembly 106 includes a flap 240 that is pivotally mounted over dispensing chute 210. In addition, a resilient element, illustrated as a torsional spring 242 may be mechanically coupled to the flap 240 to urge flap 240 toward the closed position. The tension in the spring may be selected such that ice 108 is only dispensed through discharge outlet 208 when desired. By contrast, flap 240 may prevent undesirable discharge of ice 108 through discharge outlet 208 (e.g., such as when auger 202 is rotating in the reverse direction).

In addition, ice dispensing assembly 106 may generally include one or more sensors configured for determining an ice level within ice bin 200 or otherwise determining when ice 108 has reached a particular height or threshold within ice bin 200. For example, according to the illustrated embodiment, ice dispensing assembly 106 includes a level sensor 250 that is positioned proximate a top 252 of ice bin 200. In general, level sensor 250 may be triggered when ice 108 within ice bin 200 reaches a predetermined level (e.g., as identified by dotted line 254). According to exemplary embodiments, controller 176 may be in operative communication with level sensor 250 and may be configured for stopping ice production when ice 108 reaches the predetermined level 254, e.g., to prevent overfilling ice bin 200. According to exemplary embodiments, level sensor 250 may be any suitable optical, acoustic, electromagnetic, or other sensors suitable for detecting the presence of ice 108. For example, these level sensors may include proximity sensors, time of flight sensors, infrared sensors, optical sensors, etc.

Now that the construction of ice making appliance 100 according to exemplary embodiments has been presented, an exemplary method 300 of operating an ice making appliance 100 will be described. Although the discussion below refers to the exemplary method 300 of operating ice making appliance 100, one skilled in the art will appreciate that the exemplary method 300 is applicable to the operation of a variety of other ice making appliances. In exemplary embodiments, the various method steps as disclosed herein may be performed by a controller of ice making appliance 100 or a separate, dedicated controller.

Notably, as best illustrated in FIG. 6, ice 10 may have a tendency to accumulate in ice bin 200 in a manner that prematurely triggers the level sensor 250. In this regard, for example, because supply chute 156 is positioned above rear end 206 of ice bin 200, ice 108 is deposited proximate rear end 206 and tends to form a pile or collect against a back wall of ice bin 200. Thus, ice 108 typically reaches the predetermined level 254 as the rear center of ice bin 200 fills with ice. However, the side and the front portions of ice bin 200 are typically not filled such that the total capacity of ice bin 200 is never fully utilized. Accordingly, aspects of the present subject matter are directed to systems and methods for ensuring a more even distribution of ice 108 within ice bin 200 to enhance the ice capacity and storage within ice bin 200.

Figure 9:
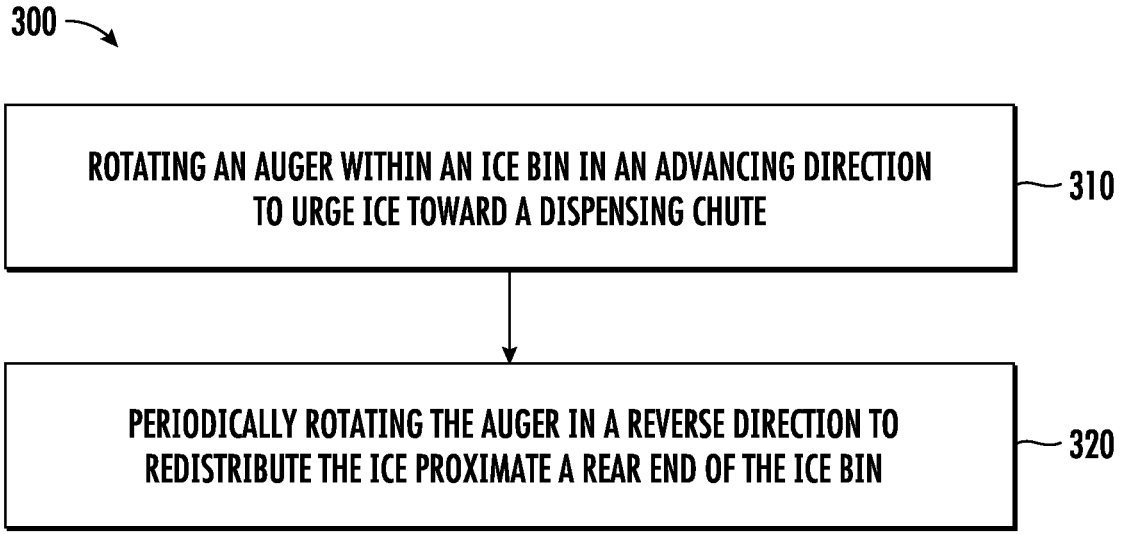
FIG. 9 provides a method for operating an ice making appliance to enhance ice storage capacity according to an exemplary embodiment of the present subject matter.

Referring now to FIG. 9, method 300 includes, at step 310, rotating an auger within an ice bin in an advancing direction to urge ice toward the dispensing chute. In this regard, continuing the example from above, motor assembly 220 may generally rotate auger 202 in an advancing direction (e.g., in a clockwise direction when viewed from front end 204 of ice bin 200) to urge ice 108 from rear end 206 through the bottom trough 214 toward discharge outlet 208. Notably, this rotation may be typical during an ice dispensing operation. However, as noted above, rotation in only this direction may generally result in a poor distribution of ice 108 with ice bin 200 and a premature triggering of level sensor 250 along with the stopping of ice formation.

Thus, step 320 may include periodically rotating the auger in a reverse direction to redistribute the ice proximate a rear end of the ice bin. In this regard, for example, by rotating auger 202 in the reverse direction, e.g., thereby urging ice 108 away from discharge outlet 208 and toward the rear end 206 of ice bin 200, the ice 108 has a tendency to spread along the lateral direction L toward the sides of ice bin 200 as well as push forward in ice bin 200 along the transverse direction T. In this manner, by intermittently or periodically reversing the direction of auger 202, the level of ice 108 with an ice bin 200 may be maintained in a more desirable manner.

According to exemplary embodiments, the occurrence of reverse rotation of auger 202 may be time-dependent, may be dependent on the triggering of a sensor, or may be triggered upon the occurrence of any other event. For example, according to an exemplary embodiment, periodically rotating the auger in the reverse direction may include rotating the auger in the reverse direction for a predetermined rotation time and at a predetermined rotation interval. In this regard, for example, the auger rotation may be reversed at a predetermined interval such as between about every 1 minute and 30 minutes, between about every 3 minutes and 20 minutes, between about every 5 minutes and 15 minutes, or about every 10 minutes. In addition, the duration or predetermined rotation time may vary as needed to properly redistribute ice 108 within ice bin 200. In this regard, for example, the predetermined rotation time may be between about 1 and 30 seconds, between about 3 and 20 seconds, between about 5 and 15 seconds, or about 10 seconds. It should be appreciated that other predetermined time intervals and rotation times may be used while remaining within the scope of the present subject matter.

Moreover, it should be appreciated that level sensor 250 may be used to determine when reverse rotation is needed. In this regard, according to exemplary embodiments, method 200 may include determining that the ice has reached the predetermined level 254 by using the level sensor 250. When this occurs, method 200 may include initiating rotation of the auger in the reverse direction for a predetermined amount of time, e.g., such as around 5, 10, or 15 seconds. It should be appreciated that this reverse rotation may be performed at any other suitable frequency, duration, intensity, etc.

FIG. 9 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 300 is explained using ice making appliance 100 as an example, it should be appreciated that this method may be applied to the operation of any suitable ice making appliance or ice dispensing assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making appliance comprising:

an ice maker for producing ice, an ice bin defining a bottom trough that extends between a rear end and a dispensing chute, wherein the ice is supplied at the rear end and is collected in the ice bin;

an auger rotatably mounted within the bottom trough of the ice bin;

a motor assembly mechanically coupled to the auger for selectively rotating the auger;

a deflector positioned at least partially within the ice bin and above the auger proximate the dispensing chute, the deflector being configured to prevent the ice from falling through the dispensing chute when the auger is rotating in a reverse direction; and a controller operably coupled to the motor assembly, the controller being configured to:

rotate the auger in an advancing direction to urge the ice toward the dispensing chute; and periodically rotate the auger in the reverse direction to redistribute the ice proximate the rear end of the ice bin.

2. The ice making appliance of claim 1, wherein periodically rotating the auger in the reverse direction comprises:

rotating the auger in the reverse direction for a predetermined rotation time and at a predetermined time interval.

3. The ice making appliance of claim 2, wherein the predetermined rotation time is between about 5 and 15 seconds.

4. The ice making appliance of claim 2, wherein the predetermined time interval is between about 5 and 15 minutes.

5. The ice making appliance of claim 2, wherein the predetermined rotation time is about 10 seconds and the predetermined time interval is about 10 minutes.

6. The ice making appliance of claim 1, further comprising:

a level sensor positioned proximate a top of the ice bin, the level sensor being triggered when the ice exceeds a predetermined level within the ice bin.

7. The ice making appliance of claim 6, wherein the controller is further configured to:

determine that the ice has reached the predetermined level using the level sensor; and initiate rotation of the auger in the reverse direction in response to determining that the ice has reached the predetermined level.

8. The ice making appliance of claim 6, wherein the level sensor is an infrared sensor.

9. The ice making appliance of claim 1, wherein the bottom trough is angled from the rear end upward toward the dispensing chute.

10. The ice making appliance of claim 1, wherein the auger is tapered toward the dispensing chute.

11. The ice making appliance of claim 1, wherein the deflector is arcuate and wraps at least partially around the auger.

12. The ice making appliance of claim 1, wherein the deflector defines a deflector depth measured along a transverse direction that is greater than about a quarter of a bin depth measured along the transverse direction.

13. The ice making appliance of claim 1, further comprising:

a flap pivotally mounted over the dispensing chute; and a resilient element for urging the flap toward a closed position.

14. The ice making appliance of claim 1, wherein the ice maker defines a supply chute above the ice bin proximate the rear end of the ice bin.

15. A method for operating an ice making appliance, the ice making appliance comprising an ice bin defining a bottom trough that extends between a rear end and a dispensing chute, an auger rotatably mounted within the bottom trough of the ice bin, a motor assembly mechanically coupled to the auger for selectively rotating the auger, and a deflector positioned at least partially within the ice bin and above the auger proximate the dispensing chute, the deflector being configured to prevent the ice from falling through the dispensing chute when the auger is rotating in a reverse direction, the method comprising:

rotating the auger in an advancing direction to urge ice toward the dispensing chute; and periodically rotating the auger in the reverse direction to redistribute the ice proximate the rear end of the ice bin.

16. The method of claim 15, wherein periodically rotating the auger in the reverse direction comprises:

rotating the auger in the reverse direction for a predetermined rotation time and at a predetermined time interval.

17. The method of claim 16, wherein the predetermined rotation time is about 10 seconds and the predetermined time interval is about 10 minutes.

18. The method of claim 15, wherein the ice making appliance further comprises a level sensor positioned proximate a top of the ice bin, the level sensor being triggered when the ice exceeds a predetermined level within the ice bin, the method further comprising:

determining that the ice has reached the predetermined level using the level sensor; and initiating rotation of the auger in the reverse direction in response to determining that the ice has reached the predetermined level.

19. The method of claim 15, wherein the ice making appliance further comprises a deflector positioned above the auger proximate the dispensing chute, the deflector being configured to prevent the ice from falling through the dispensing chute when the auger is rotating in the reverse direction.

* * * * *